US009730508B2

(12) United States Patent
Han

(10) Patent No.: US 9,730,508 B2
(45) Date of Patent: Aug. 15, 2017

(54) BACKPACK FOR A MOBILE DEVICE USER

(71) Applicant: Min-Hyung Han, Seoul (KR)

(72) Inventor: Min-Hyung Han, Seoul (KR)

( * ) Notice: Subject to any disclaimer, the term of this patent is extended or adjusted under 35 U.S.C. 154(b) by 0 days.

(21) Appl. No.: 14/896,155

(22) PCT Filed: Jun. 3, 2014

(86) PCT No.: PCT/KR2014/004954

§ 371 (c)(1),
(2) Date: Dec. 4, 2015

(87) PCT Pub. No.: WO2014/196800

PCT Pub. Date: Dec. 11, 2014

(65) Prior Publication Data

US 2016/0128454 A1 May 12, 2016

(30) Foreign Application Priority Data

Jun. 4, 2013 (KR) ..... 10-2013-0064009

(51) Int. Cl.
*A45F 3/04* (2006.01)
*A45F 4/02* (2006.01)
(Continued)

(52) U.S. Cl.
CPC ..... *A45F 4/02* (2013.01); *A45C 9/00* (2013.01); *A45C 11/00* (2013.01); *A45F 3/04* (2013.01);
(Continued)

(58) Field of Classification Search
CPC ..... A45F 4/02; A45F 3/04; A45F 5/00; A45F 2004/003; A45F 2003/003; A45C 11/00; A45C 9/00; A45C 2200/15
(Continued)

(56) References Cited

U.S. PATENT DOCUMENTS 3,090,330 A * 5/1963 Best ..... A45F 5/00 108/135
3,541,976 A * 11/1970 Rozas ..... A47B 23/002 108/43
(Continued)

FOREIGN PATENT DOCUMENTS

AU WO 2012024723 A1 * 3/2012 ..... A45C 11/00
JP 3067115 U 12/1999
(Continued)

OTHER PUBLICATIONS

International Search Report for International Application No. PCT/KR2014/004954 and translation mailed Oct. 10, 2014, 5 pages.
(Continued)

*Primary Examiner* — Adam Waggenspack
*Assistant Examiner* — Lester L Vanterpool
(74) *Attorney, Agent, or Firm* — Billion & Armitage; Benjamin C. Armitage

(57) ABSTRACT

The present invention discloses a back pack for a mobile device user.

A back pack for a mobile device user according to the present invention comprises a body; a support board adjacently facing a front side of the body in parallel; a hinge, being provided on the front side or on a lateral side of the body, for pivotally coupling the support board and the body; and a multiple positioning fix unit to fix the support board at an open position, wherein the support board is pivotally coupled to the body by the hinge and the multiple positioning fix unit so as to adjust an open angle of the support board.

11 Claims, 13 Drawing Sheets

(51) Int. Cl.

| | |
|---|---|
| ***A45C 9/00*** | (2006.01) |
| ***A45C 11/00*** | (2006.01) |
| ***A45F 5/00*** | (2006.01) |
| *A45F 3/00* | (2006.01) |
| *A45F 4/00* | (2006.01) |

(52) U.S. Cl.
CPC ..... *A45F 5/00* (2013.01); *A45C 2200/15* (2013.01); *A45F 2003/003* (2013.01); *A45F 2004/003* (2013.01)

(58) Field of Classification Search
USPC ..... 224/153, 655, 657
See application file for complete search history.

(56) References Cited

U.S. PATENT DOCUMENTS

| | | | | | |
|---|---|---|---|---|---|
| 5,046,433 | A * | 9/1991 | Kramer | B60N 3/004 | 108/44 |
| 5,222,641 | A * | 6/1993 | Medeiros, Jr. | A47D 13/025 | 224/161 |
| 5,269,229 | A * | 12/1993 | Akapatangkul | B60N 3/004 | 100/47 |
| 5,509,590 | A * | 4/1996 | Medeiros, Jr. | A47D 13/025 | 224/161 |
| 5,694,860 | A * | 12/1997 | Xiao | A47B 3/00 | 108/38 |
| 5,813,354 | A * | 9/1998 | Scott | B60N 3/004 | 108/44 |
| 5,911,348 | A * | 6/1999 | Shook | A45F 3/04 | 224/153 |
| 5,984,347 | A * | 11/1999 | Blanc-Rosset | B60N 3/004 | 224/275 |
| 6,296,165 | B1 * | 10/2001 | Mears | A45C 3/00 | 224/153 |
| 6,659,319 | B2 * | 12/2003 | Purpura | A45C 9/00 | 224/270 |
| 6,830,292 | B1 * | 12/2004 | Yoda | B60N 3/004 | 108/44 |
| 8,807,406 | B1 * | 8/2014 | Thach | A45F 5/00 | 224/153 |
| 2002/0139820 | A1 * | 10/2002 | Godshaw | A45F 4/02 | 224/153 |
| 2010/0108726 | A1 * | 5/2010 | Hilgenberg | A45C 11/00 | 224/153 |
| 2010/0116860 | A1 * | 5/2010 | Tello | A45F 3/04 | 224/576 |
| 2011/0127304 | A1 * | 6/2011 | Kam | A45F 3/04 | 224/153 |
| 2012/0175396 | A1 | 7/2012 | Patino | | |

FOREIGN PATENT DOCUMENTS

| | | | | |
|---|---|---|---|---|
| JP | 2000-014426 | A | 1/2000 | |
| JP | 2008-212602 | A | 9/2008 | |
| JP | 2011-036401 | A | 2/2011 | |
| KR | 200302833 | Y1 | 2/2003 | |
| KR | 20060112902 | A | 11/2006 | |
| KR | 200453219 | Y1 | 4/2011 | |
| KR | 20120008829 | U | 12/2012 | |
| WO | WO2012024723 | A1 * | 3/2012 | A45C 11/00 |

OTHER PUBLICATIONS

Written Opinion for International Application No. PCT/KR2014/004954 and translation mailed Oct. 10, 2014, 14 pages.

* cited by examiner

BACKPACK FOR A MOBILE DEVICE USER

TECHNICAL FIELD

The present invention relates to a back pack for a mobile device user.

More specifically, the present invention relates to a back pack for a mobile device user where a front side of a main body of a back pack is provided with a collapsible support board thereby enabling to control length, rotation, and rotational angle of the collapsible support board such that the present invention makes a user to be able to use a mobile device in a stable and convenient way, helps in physical health through keeping a proper posture of the user's body when using the mobile device, and has additional functions such as being used as a book stand, etc.

BACKGROUND TECHNOLOGY

Generally, a mobile device user holds a mobile device with either one hand or two hands and uses it. After a user gets caught up on a mobile device for a long time on a chair or a sofa, prolonged holding or gripping of a mobile device leads to fatigue of the lifted hands and arms. This causes the user's hands and arms to be lowered downward, and thus the user mostly operates the mobile device, keeping a poor posture as illustrated in FIG. 11. If a mobile device user keeps such a poor posture for a long time, the poor posture causes a harmful influence against the user's health. In addition, a user looks continuously downward with too much close distance between the user's eyes and the mobile device, which makes easily the user to become short-sighted. The poor posture causes typically "Forward Head Posture (FHP) Syndrome" generally known as "Text Neck Syndrome" to the user. Therefore, there is a high possibility that a user may have some following chronic diseases such as a herniated cervical disc, a lumbar herniated intervertebral disc, elbow disease, carpel tunnel syndrome, and deteriorated vision, etc., as long as the user spends a long time with a mobile device.

Meanwhile, back packs are preferably popular with many persons including young generation who use various mobile devices. Backpacks are generally designed to carry them on the user's shoulders or backs by using suspenders. Because the large compartment of backpacks offers plenty of storage space, they have some advantages that enable them to put and carry relatively larger amount of contents therein and thus make users free their both hands, unlike general bags typically only with handles.

Particularly, backpack users, who also use mobile devices, usually carry an allotment of relatively heavy types of mobile devices such as notebook PCs or tablet PCs, etc. and use them frequently so that the afore-mentioned problems seriously increase the bad affects to the users.

Regarding a backpack relating to a mobile device, Korean Utility Model Registration No. 20-0302833, entitled "KNAPSACK TYPE AUDIO AND VIDEO SYSTEM," discloses a structure where audio and video devices are inputted into an inside of a knapsack and are used at home, out of door, and in a vehicle. Further, Korean Patent Laid-Open Publication No. 10-2006-0112902, entitled "HOLDER CONNECTED WITH A STRIP OF A BAG", discloses a structure where a mobile device for voice communications is held on a strap of a back pack. Further, Korean Utility Model Registration No. 20-0453219, entitled "Tablet PC Case Which Is Removable From The Bag", discloses a structure where a tablet PC, etc. is held on one side of a bag. Further, Korean Utility Model Laid-Open Publication No. 20-2012-0008829, entitled "Handle Bag For Smart Mobile Phone Holder", discloses a structure where a groove is formed on a handle of a bag and a smart phone is inserted and fixed in the groove. Further, US Patent Application Publication No. 2012-0175396, entitled "Structural support device for laptop and portable electronic device carrying cases", discloses a structure where a user carries a notebook computer inside of a back pack or a shoulder bag and uses the notebook computer by opening a front side thereof while wearing the bag on the user's body.

However, although the prior arts as described above disclosing a backpack relating to a mobile device are possible to apply to some of portable electronic devices, they are not sufficiently enough to solve the problems occurred to the users who use a mobile device as described above, and also are very unsatisfactory to provide convenience which can apply to all the users of the mobile device.

Accordingly, a new breakthrough for solving the afore-mentioned problems is required.

DETAILED DESCRIPTION

Technical Problem to be Solved

The object of the present invention is to solve the prior art problems, by providing a back pack for a mobile device user where a front side of a main body of a back pack is provided with a collapsible support board thereby enabling to control length, rotation, and rotational angle of the collapsible support board such that the present invention makes a user to be able to use a mobile device in a stable and convenient way, helps in physical health through keeping a proper posture of the user's body when using the mobile device, and has additional functions such as being used as a book stand, etc.

Technical Solution

According to one aspect of the present invention, the present invention provides a back pack for a mobile device user comprising a body; a support board adjacently facing a front side of the body in parallel; a hinge, being provided on the front side or on one or both of lateral sides of the body, for pivotally coupling the support board and the body; and a multiple positioning fix unit to fix the support board at an open position, wherein the support board is pivotally coupled to the body by the hinge and the multiple positioning fix unit so as to adjust an open angle of the support board.

Advantageous Effect

When using a back pack for a mobile device user of the present invention, the following advantages are accomplished:

1. When using mobile devices, a user of the mobile devices can use them very stably and conveniently and keep a proper posture of the user's body, which helps the user stay healthy.

2. A user can use mobile devices by opening a collapsible support board appropriately while the user keep standing position after wearing a back pack according to the present invention in a front direction to the user.

3. A collapsible support board mounted on a back pack of the present invention has an additional function as a book stand onto which general books as well as mobile devices can be held and used. Even in this case, a user can keep a proper posture, which gives the user much convenience and greatly helps the user stay healthy.

Further features and advantages of the present invention can be obviously understood with reference to the accompanying drawings where same or similar reference numerals indicate same components.

MODE FOR THE INVENTION

Hereinafter, the present invention will be described in more detail with reference to the embodiments of the present invention and the appended drawings.

Figure 1:
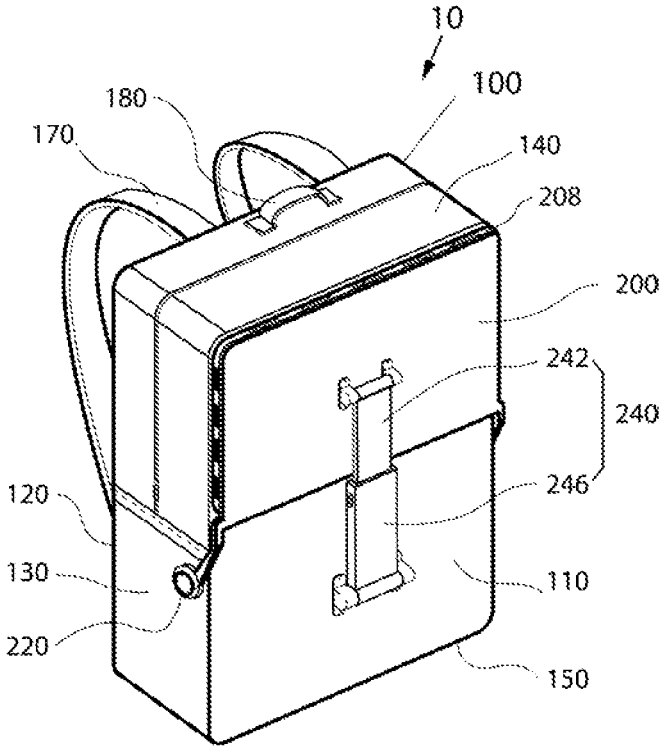
FIG. 1 illustrates a perspective view of a back pack structure for a mobile device user according to one embodiment of the present invention.

FIG. 1 illustrates a perspective view of a back pack structure for a mobile device user according to one embodiment of the present invention.

Referring to FIG. 1, a back pack 10 for a mobile device user according to one embodiment of the present invention comprises a body 100 of the back pack, a support board 200, a hinge 220, and a multiple positioning fix unit 240. It should be noted that the present invention as illustrated in FIG. 1 illustrates an exemplary embodiment applied to a general type of a back pack. Hereinafter, a back pack 10 for a mobile device user may be described merely as a back pack 10, if necessary, for a convenient purpose.

The body 100 may be a main body of the back pack 10, has a handle 180 for lifting it by hand or a suspender 170 for carrying it on a shoulder, and has one or more pockets (not shown), if necessary. The body 100 comprises a front side 100, a back side 120, two lateral sides 130, a top side 140, and a bottom side 150.

First Embodiment

Figure 2A:
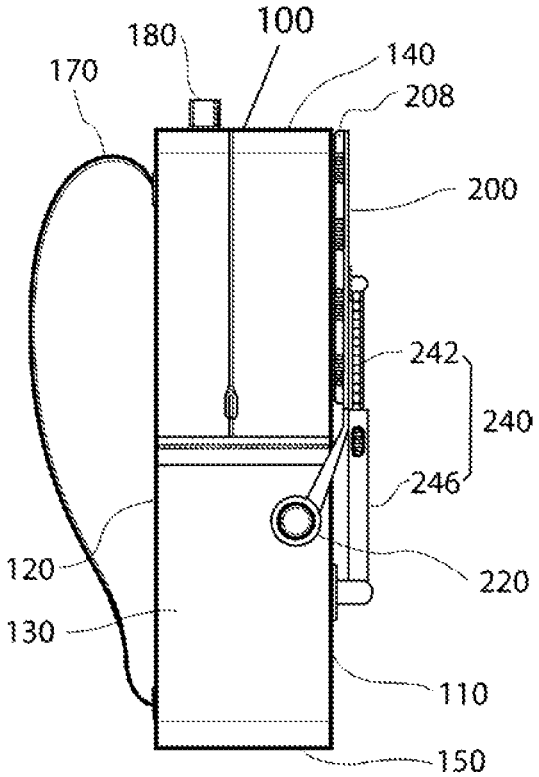
FIG. 2*a* illustrates a side view of a back pack for a mobile device user according to a first embodiment of the present invention.
Figure 2B:
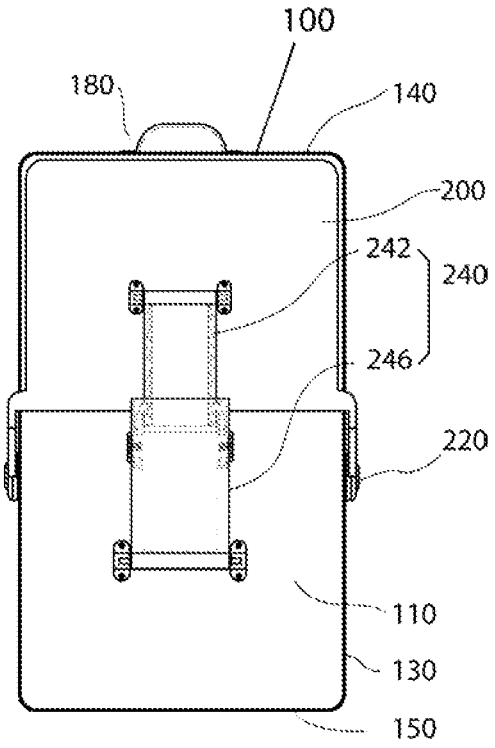
FIG. 2*b* illustrates a front view of a back pack for a mobile device user according to a first embodiment of the present invention.

FIG. 2*a* illustrates a side view of a back pack for a mobile device user according to a first embodiment of the present invention, and FIG. 2*b* illustrates a front view of a back pack for a mobile device user according to a first embodiment of the present invention.

Figure 3:
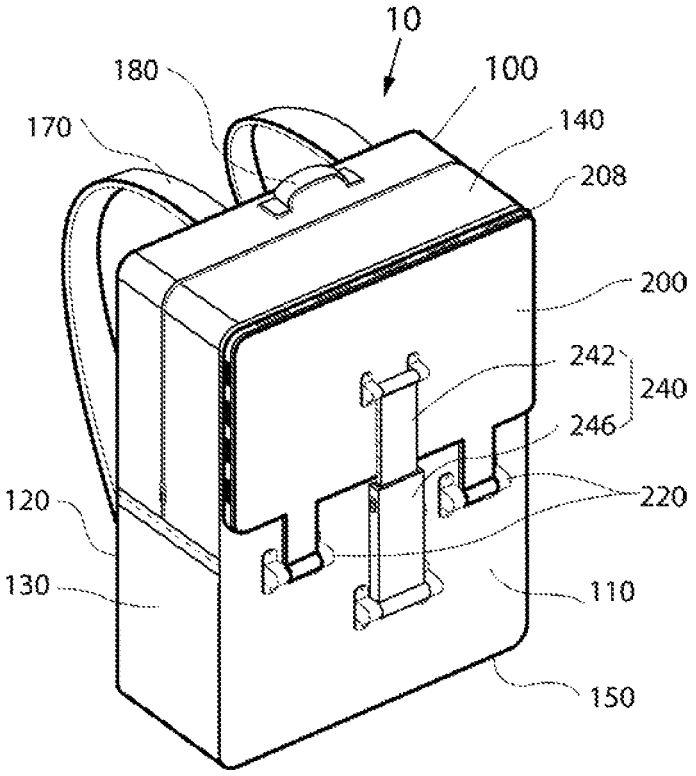
FIG. 3 illustrates a perspective view illustrating an alternative embodiment of a back pack for a mobile device user according to a first embodiment of the present invention as illustrated in FIG. 1.

Referring to FIGS. 2*a* and 2*b* together with FIG. 1, when the user is not using the support board 200 of the back pack 10 or moves the back pack 10 while carrying the back pack 10, the support board 200 is adjacently facing the front side 110 of the body 100 in parallel to be kept in a closed state. The support board 200 is pivotally coupled to the body 100 by the hinge 220 which is provided on the front side 110 or on the lateral side(s) 130. As a result, the support board 200 can be rotated pivotally and opened to a desired degree of angle about the hinge 220 with respect to the front side 110. Although the hinge 220 is installed on the lateral side(s) 130 of the body 100 as illustrated in FIGS. 1, 2*a* and 2*b*, respectively, it should be noted that the hinge 220 is to be installed on the front side 110 of the body 100, as illustrated in FIG. 3 and will be described later. That is, the hinge 220 of the back pack 10 of the present invention 10 can be installed either on the front side 110 or on the lateral side(s) 130. The hinge 220 provides a function for holding or supporting at least a portion of the support board 200 together with the multiple positioning fix unit 240, which will be described in detail.

Figure 2C:
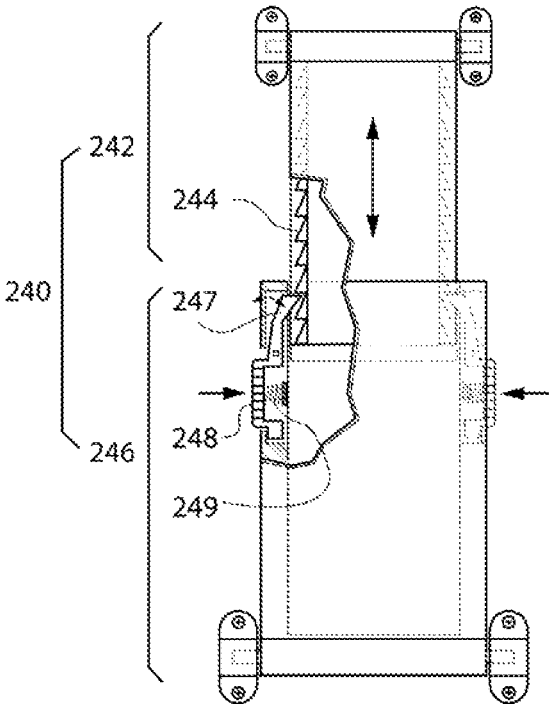
FIG. 2*c* illustrates a partial cutting view for explaining a multiple positioning fix unit being used for a back pack for a mobile device user according to a first embodiment of the present invention.

FIG. 2*c* illustrates a partial cutting view for explaining a multiple positioning fix unit being used for a back pack for a mobile device user according to a first embodiment of the present invention.

Referring to FIG. 2*c* together with FIGS. 2*a* and 2*b*, the multiple positioning fix unit 240 may be embodied, for example, by a linear type ratchet assembly. Such a linear type ratchet assembly comprises an outer member 246 and an inner member 242 being coupled to the outer member 246 in a mutually slidable manner. A top portion of the inner member 242 is coupled to an outer surface 202 (not shown in FIGS. 1 to 3, see FIG. 4) of the support board 200 in a hinge type to be freely rotatable. A bottom portion of the outer member 246 is also coupled on the front side 110 of the support board in a hinge type to be freely rotatable. The outer member 246 has a reception space enough for the inner member 242 to be inserted completely thereinto. That is, the inner member 242 is structured to be linearly moved in a sliding manner inside the receipt space of the outer member 246. A plurality of protrusions 244 in a shape having downwardly biased teeth is provided on both sides of the inner member 242, while a stopper 245, which is to be engaged with the plurality of protrusions 244, is provided on the outer member 246. The stopper 245 is coupled to a release button 248 in a pivotally rotatable manner about a rotational axis 247. A spring 249 is provided inside the release button 248 and thus exerts biased restoring force against the release button 248 toward an outside direction from inside. As a result, a protrusion 244 provided on the inner member 242 and the stopper 245 are strongly engaged by the restoring force of the spring 249 so that the movement of the inner member 242 is restricted in order for the inner member 242 not to be inserted into the receipt space of the outer member 246 as long as the engagement of the release button 248 is not released. When pressing the release button 248 toward an inside direction from outside as an indicated arrow, the stopper 245 being engaged with the protrusion 244 of the inner member 242 makes a gap toward an outside direction from inside so that the engagement of the protrusion 244 and the stopper 245 is released. As a result, the inner member 242 can be moved freely inside the receipt space of the outer member 246. That is, as illustrated in FIGS. 2*a* to 2*c*, upon releasing the engagement between the protrusion 244 and the stopper 245 by pressing the release button 248 under a condition that the support board 200 is in a closed state, the inner member 242 can be freely moved so as to open the support board 200 to a desired angle. When a user removes the user's hand from the release button 248, the stopper 245 is engaged again with the protrusion 244 automatically and thus fixes the support board 200 at a desired open position. Meanwhile, because the inner member 242 can be moved freely in a direction away from the outer member 246 (toward an upper direction shown in FIG. 2*a*), the user can move the support board 200 to an initially closed position as illustrated in FIG. 2*a*, regardless of the engagement between the protrusion 244 and the stopper 245. That is, it can be recognized that the user can always move the support board 200 freely in one direction such as an upward direction.

Figure 12:
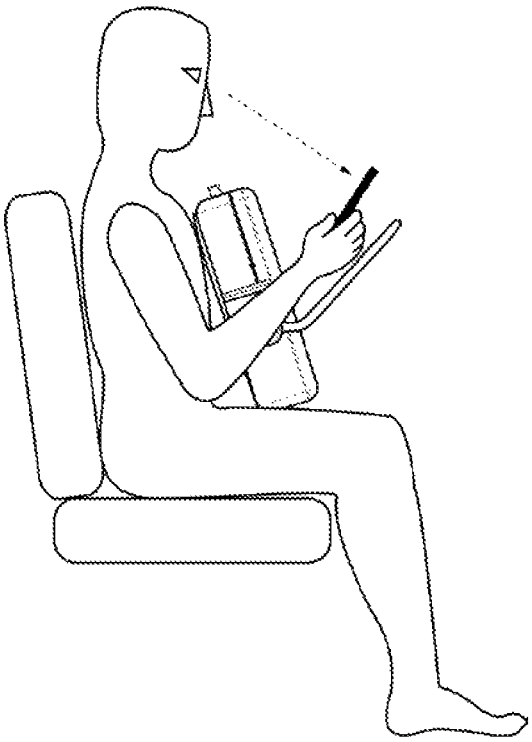
FIG. 12 illustrates a side view of a desirable posture of the user while using a mobile device on a back pack according to the present invention in a standing position.
Figure 13:
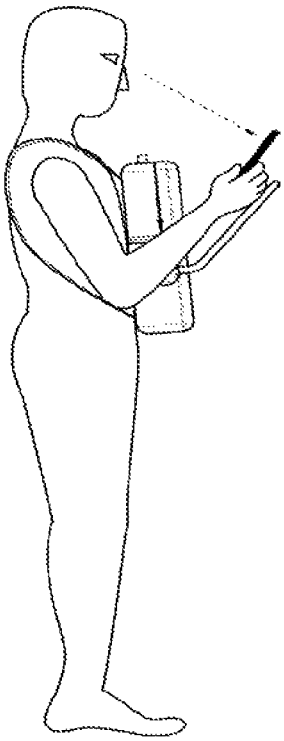
FIG. 13 illustrates a side view of a desirable posture of the user while using a mobile device on a back pack according to the present invention in a standing position.
Figure 14:
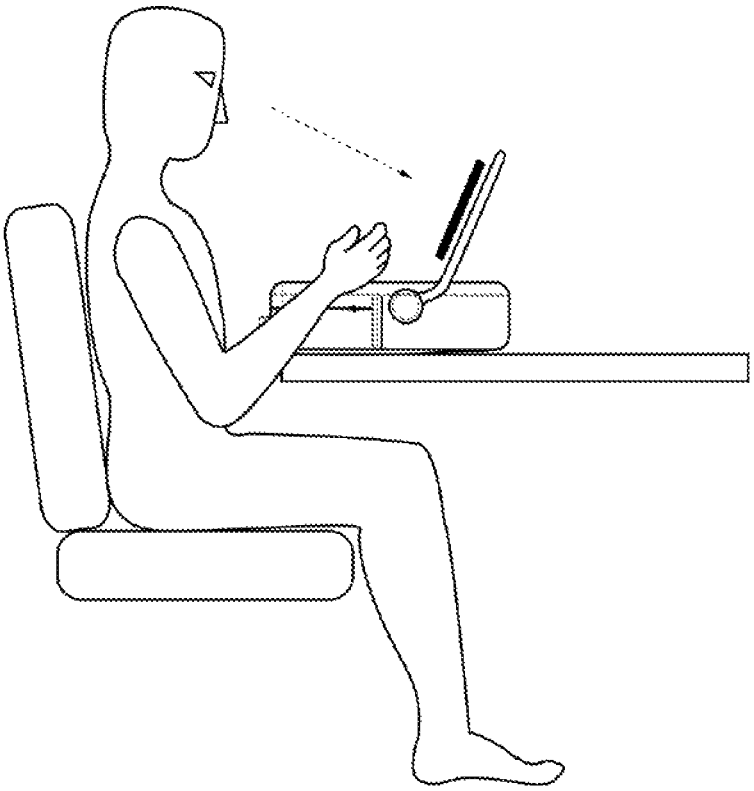
FIG. 14 illustrates a side view of a desirable posture of the user while using a mobile device on a back pack according to the present invention on a desk.

The open angle between the back pack 10 and the support board 200 may vary depending on the individual height and personal preference to a posture of the mobile device user. Thus, the user can use the back pack 10 by placing the front side 110 thereof in a vertical, horizontal, or tilted state on the user's lap and adjusting the open angle of the support board 200 appropriately, depending on the user's convenience, for example, at a sitting or standing position as illustrated in FIGS. 12 to 14, which will be described in detail later.

As described in detail above, the support board 200 is rotated pivotally and opened to a desired degree of angle from the front side 110 of the back pack 10, e.g., by the multiple positioning fix unit 240 such as a linear type ratchet assembly, and then is fixed securely at a desired position. Therefore, since the support board 200 can sufficiently support the weight of the support board 200 itself and the load due to the mobile device, and the user's hands or arms as well to be placed on the support board 200, the user can use the mobile device on the support board 200 conveniently with keeping a stable and preferable posture as will be described in detail later with reference to FIGS. 12 to 14.

In the embodiments of FIGS. 1 to 4 as described in detail above, the hinge 220 provided on the lateral side(s) 130 and the multiple positioning fix unit 240 provided on the front side 110 are formed as a separable type where the hinge 220 and the multiple positioning fix unit 240 can be separated each other.

It is desirable that the lateral sides 130 and the multiple positioning fix unit 240 are respectively formed as a light weight type, for example, by using a plastic material or a metal material. Further, although the multiple positioning fix unit 240 of the present invention is illustratively described to be embodied as a linear type ratchet assembly in the embodiments depicted in FIGS. 1 to 2*c*, any skilled in the art can fully understand that the multiple positioning fix unit 240 for adjusting an open angle of the support board 200 may be embodied in various manners by using a known structure such as a telescope type or a slide rail type.

FIG. 3 illustrates a perspective view illustrating an alternative embodiment of a back pack for a mobile device user according to a first embodiment of the present invention as illustrated in FIG. 1.

Referring to FIG. 3, the back pack 10 according to an alternative embodiment of the present invention is substantially the same as the back pack 10 according to the first embodiment of the present invention as illustrated in FIG. 1, except that the hinge 220 being connected and coupled to the support board 200 is provided on the front side 110, rather than on the lateral side(s) 130. Therefore, the detailed description on the specific structure and operations of the back pack 10 according to the alternative embodiment of the present invention illustrated in FIG. 3 will be omitted.

In the meanwhile, if the user does not use the user's hands or arms such as a case when the user enjoys moving images, etc., while placing the mobile device on the support board 200 (i.e., the user uses the mobile device without gripping it), it is necessary to provide a structure for preventing the mobile device from sliding down out of the support board 200.

Figure 4:
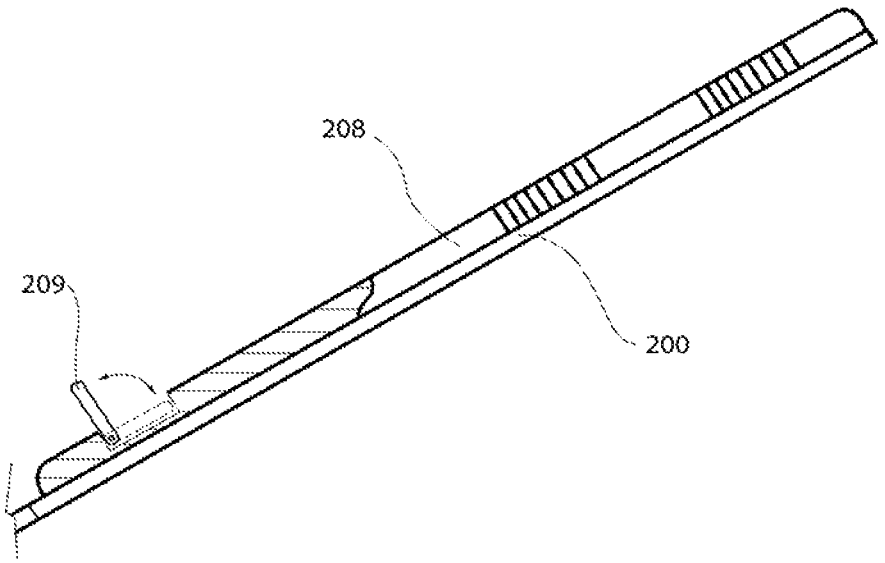
FIG. 4 illustrates a partial cross-sectional view illustrating a structure where a ledge member is provided on a support board which is used for a back pack for a mobile device user according to the present invention illustrated in FIGS. 1 to 3.

FIG. 4 illustrates a partial cross-sectional view illustrating a structure where a resilient layer member 208 and a ledge member 209 are provided on the support board 200 which is used for a back pack for a mobile device user according to the present invention illustrated in FIGS. 1 to 3.

As illustrated in FIG. 4, the resilient layer member 208, made of a known resilient material such as, e.g., rubber, sponge, latex resin, flexible PVC, expandable urethane resin, or air cushion, etc., can be additionally provided on at least a partial or whole area of the support board 200. This resilient layer member 208 provides a cushion function for supporting the user's skin and bone-muscle softly when placing the user's hands or arms on the support board 200 so that the user can use the mobile device comfortably without feeling fatigue even using the mobile device for a long time. Further, the resilient layer member 208 also provides a function for protecting the mobile device itself by reducing an impact on the mobile device and any possible scratch occurring on a casing of the mobile device.

Although a structure illustratively depicting the resilient layer member 208 being provided on the support board 200 of the back pack 10 for the mobile device user according to the present invention is described illustratively in FIGS. 1 to 4 and all other subsequent figures, any skilled person in the art can fully understand that only the support board 200 on which the resilient layer member 208 is not provided can be used alone.

Referring again to FIG. 4 together with FIGS. 1 to 3, the ledge member 209 can be additionally provided at a lower position of either the inner surface 204 or the resilient layer member 208 of the support board 200, in order to prevent the mobile device from sliding down while the support board 200 is in an open position. In FIG. 4, it is illustrated that the ledge member 209, when not being used, is folded in a hinge manner into the inner surface 204 of the support board 200 and thus stored as an embedded type, in order to avoid any interference with the body 100, etc. It is also possible that the ledge member 209 is embodied by a magnet attachment type, etc., so as to change the position thereof randomly on the support board 200.

Further, there is a possibility that a gap space between the support board 200 and the front side 110 occurs, and the mobile device may slide down through the gap space and thus fall onto the ground. Thus, a fall-prevention member (not shown) of the mobile device, made of a flexible material such as, e.g., cloth or soft textile, net, leather, flexible plastic, etc., may be provided between the bottom of the support board 200 and the front side 110 so as to prevent the mobile device from falling downwardly.

Second Embodiment

Figure 5A:
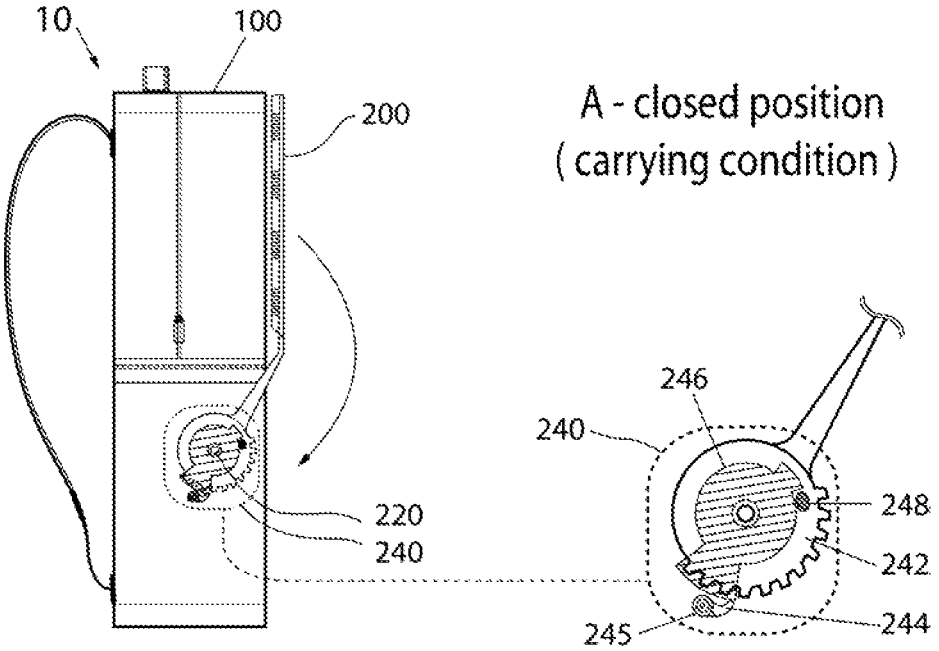
FIGS. 5*a* to 5*c* illustrate a side view for explaining a back pack for a mobile device user according to a second embodiment of the present invention, and a structure and opening operations of a support board being used thereto.
Figure 5B:
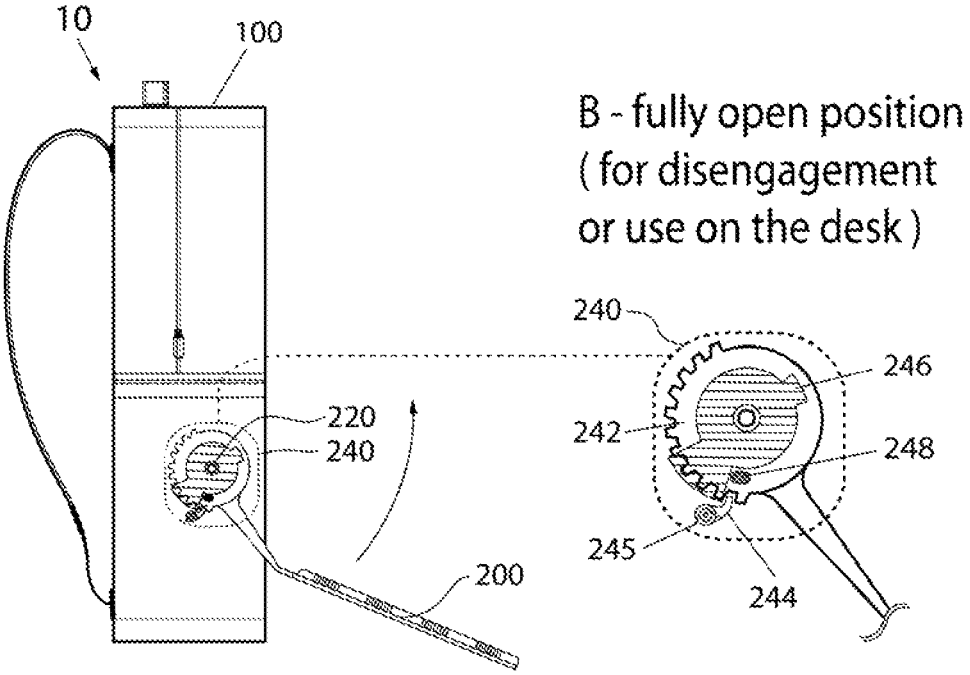
Figure 5C:
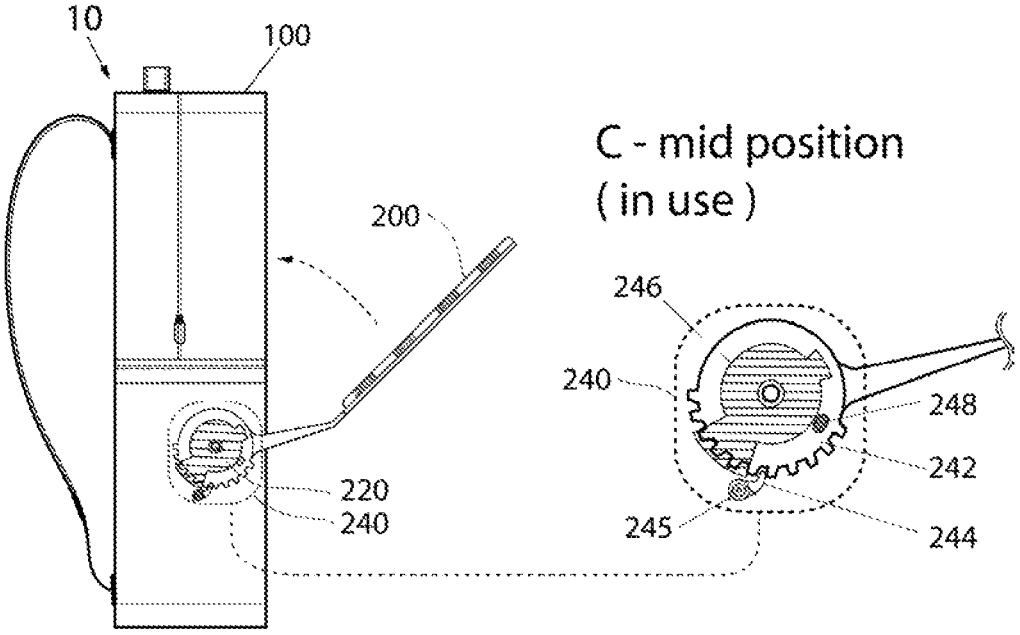

FIGS. 5*a* to 5*c* illustrate a side view for explaining a back pack for a mobile device user according to a second embodiment of the present invention, and a structure and opening operations of a support board being used thereto.

Referring to FIGS. 5*a* to 5*c*, the hinge 220 and the multiple positioning fix unit 240 are formed as an integrally combined type on the lateral sides 130, in the back pack 10 according to the second embodiment of the present invention, unlike the structure that the hinge 220 being provided on the lateral sides 130 and the multiple positioning fix unit 240 being provided on the front side 110 are formed as a separable type where the hinge 220 and the multiple positioning fix unit 240 can be separated each other.

More specifically, referring again to FIGS. 5*a* to 5*c*, the multiple positioning fix unit 240 is pivotally coupled to the hinge 220 along a coaxial axis. Further, the multiple positioning fix unit 240 is embodied by a wheel type ratchet assembly comprising a geared wheel 242, a stopper or pawl 244 (hereinafter "stopper"), a disengaging cam or a release cam 246 (hereinafter "release cam"), and a push pin 248. The geared wheel 242 is formed with a plurality of gears on a portion along an outer circumference of the geared wheel 242 in order for the support board 200 to be fixed at any arbitrary position between a position A (see FIG. 5*a*) and a position C (see FIG. 5*c*). The stopper 244 is designed to restrict the rotation of the geared wheel 242 in one direction only (a clockwise direction in FIG. 5*a*) and thus is coupled together with a restoring spring 245 which exerts biased force. The stopper 244 always exerts restoring force toward a central direction of the geared wheel 242 due to the restoring spring 245, and thus is always engaged with the geared wheel 242 unless being released by external force. Although the geared wheel 242 is restricted not to be rotated in a clockwise direction by the stopper 244, the geared wheel 242 is allowed to be rotated in a counter-clockwise direction. Further, when the release cam 246 is rotated in a counter-clockwise direction, the release cam 246 turns the stopper 244 in a clockwise direction so as to release the engagement between the stopper 244 and the geared wheel 242 (see FIG. 5*a*). Since the push pin 248 is integrally coupled to the geared wheel 242 inside an outer circumference of the geared wheel 242, the push pin 248 is designed to be rotated together as the geared wheel 242 rotates. When the geared wheel 242 rotates in a clockwise direction within a predetermined interval, the push pin 248 is also rotated together so as to contact and rotate the release cam 246 (see FIG. 5*b*). On the contrary, when the push pin 248 is rotated in a counter-clockwise direction and thus pushes the release cam 246, the release cam 246 is rotated and thus pushes the stopper 244 in a counter-clockwise direction so that the gear being engaged with the stopper 244 is released to cause the geared wheel 242 to be rotated freely (see FIG. 5*a*). In this manner, the support board 200 being coupled to the geared wheel 242 is allowed to be rotated freely in a counter-clockwise direction and thus the user can fix the support board 200 at any desired open position (or at any desired open angle).

As described in detail above, the wheel type ratchet assembly 240 and the support board 200 are coupled securely by an extension arm 210 in the embodiments illustrated in FIGS. 5*a* to 5*c*. Further, since the multiple positioning fix unit 240 is embodied as being integrally coupled to the hinge 220 along a coaxial axis, the structure and operations of the present invention can be more simplified when compared with the embodiments illustrated in FIGS. 1 and 3.

Further, when using the mobile device in a state that the mobile device and as well as the user's hands and arms are placed on the support board 200, heavy load is applied to the support board 200 so that large rotational force is exerted on the multiple positioning fix unit 240, such as a wheel type ratchet assembly, in a clockwise direction. However, the stopper 244 in the multiple positioning fix unit 240, such as a wheel type ratchet assembly, is designed to support sufficiently the geared wheel 242 so that the multiple positioning fix unit 240 and the support board 200 are prevented from being rotated in a clockwise direction.

In the meanwhile, the user can fix the support board 200 at a desired rotational angle by rotating the multiple positioning fix unit 240 little by little in a counter-clockwise direction from a position B illustrated in FIG. 5*b* and adjusting a rotational angle of the support board 200. In order to move the support board 200 from the position C (see FIG. 5*c*) to the position B (see FIG. 5*b*), it is required to pivotally rotate the support board 200 continuously in a counter-clockwise direction to cause the push pin 248 to contact a small lobe of the release cam 246 and to rotate the release cam 246 in a counter-clockwise direction. As a result, a large lobe of the release cam 246 turns the stopper 244 in a clockwise direction, and thus the stopper 244 is separated from the geared wheel 242 and releases a mutual engagement therebetween so that the support board 200 can be pivotally rotated freely in a counter-clockwise direction. When the support board 200 reaches at the position B (a completely open position) by rotating the support board 200 fully in a clockwise direction, the push pin 248 again contacts the large lobe of the release cam 246 and thus rotates the release cam 246 in a clockwise direction. As a result, since the release cam 246 is separated from the stopper 244 and the stopper 244 again is engaged with the geared wheel 242, the rotation of the support board 200 in a clockwise direction is restricted. The stopper 244 always exerts force toward a central direction of the geared wheel 242 by the restoring spring 245, and thus the stopper 244 is engaged again with a gear tooth of the geared wheel 242 immediately after the release cam 246 is separated from the stopper 244. Therefore, although the support board 200 cannot be rotated pivotally in a clockwise direction, the support board 200 can be pivotally rotated freely in a counter-clockwise direction. That is, as can be seen from FIGS. 5*a* to 5*c*, the support board 200 can be fixed with various open angles at a multiple position, by rotating thereof in a counter-clockwise direction.

Referring to the second embodiment as illustrated with reference to FIGS. 5*a* to 5*c*, all the elements comprising the back pack 10 of the present invention are desirable in that they can be embodied by a simplified structure where a small number in parts thereof and a small space are required. The geared wheel 242 may be provided either on one or both of lateral sides 130. However, it is desirable that the geared wheel 242 is provided on both lateral side(s) 130 in order for the geared wheel 242 to maintain a balance of the support board 200 and operate the support board 200 stably.

Figure 5D:
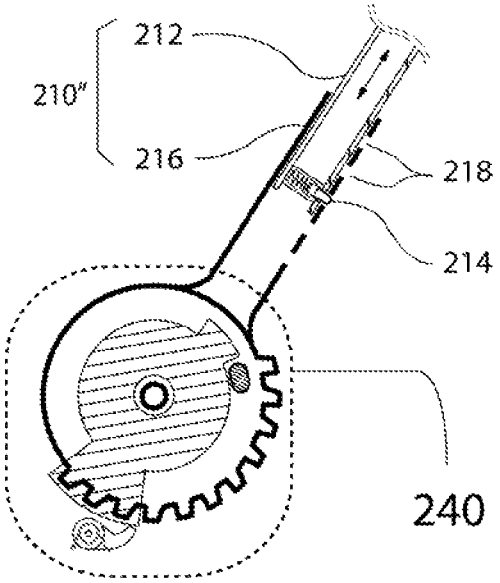
FIG. 5*d* illustrates a cross-sectional view illustrating another embodiment of a length-adjustable extension arm being used for a back pack for a mobile device user according to a second embodiment of the present invention illustrated in FIGS. 5*a* to 5*c*.

FIG. 5*d* illustrates a cross-sectional view illustrating another embodiment of a length-adjustable extension arm being used for a back pack for a mobile device user according to a second embodiment of the present invention illustrated in FIGS. 5*a* to 5*c*.

Referring to FIG. 5*d*, in another embodiment of the present invention, the extension arm 210" may comprise, e.g., an inner arm 212, an outer arm 216, which the inner arm 212 is coupled to in a linearly slidable manner, having a plurality of locking-holes 218, and a spring button 214 being provided in the outer arm 216 and being engaged with the plurality of locking-holes 218 in a spring button locking manner (e.g. for adjustable telescoping tubes). In this case, it is possible to adjust a length of the extension arm 200" by releasing the spring button 214 at a desired position for the spring button 214 to be locked up with a locking-hole 218 while moving the inner arm 212.

Further, in addition to the embodiment of the extension arm 210" illustrated in FIG. 5 as described in detail, it is possible to adjust the length of the extension arm 210" by way of adjusting the lengths of the inner arm 212 and the outer arm 216 appropriately and then assembling the inner arm 212 and the outer arm 216 using known bolts and nuts. Moreover, any skilled person in the art can fully understand that various known methods capable of adjusting the length of the extension arm 210" can be used in addition to the adjusting method of the extension arm 210" as described in detail above.

Third Embodiment

Figure 6A:
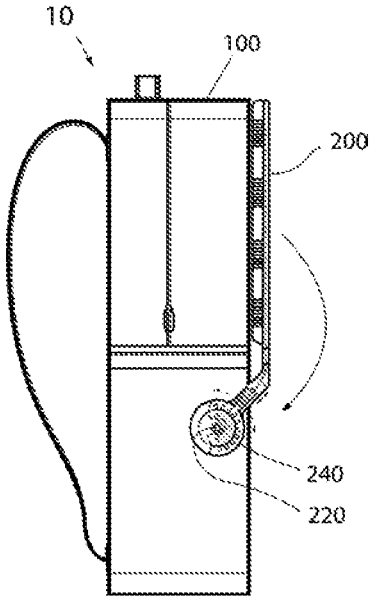
FIG. 6*a* illustrates a side view illustrating a structure of a support board being used for a back pack for a mobile device user according to a third embodiment of the present invention.
Figure 6B:
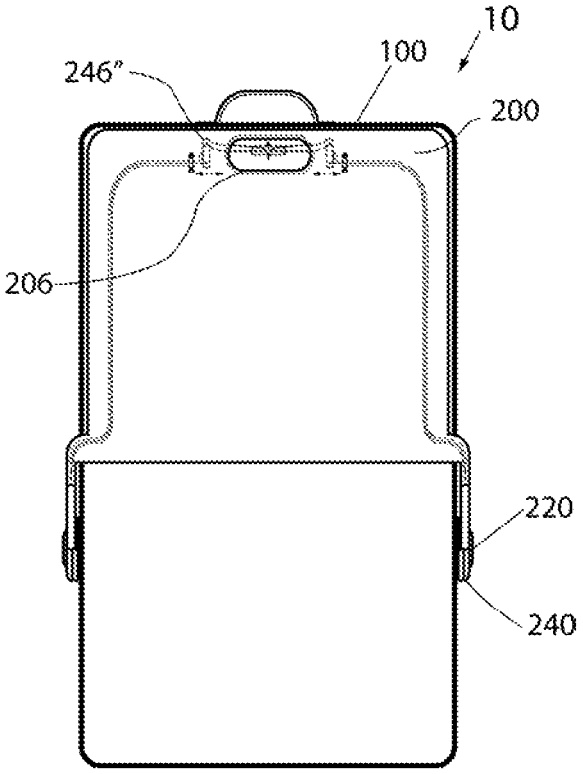
FIG. 6*b* illustrates a front view illustrating a structure of a support board being used for a back pack for a mobile device user according to a third embodiment of the present invention.
Figure 6C:
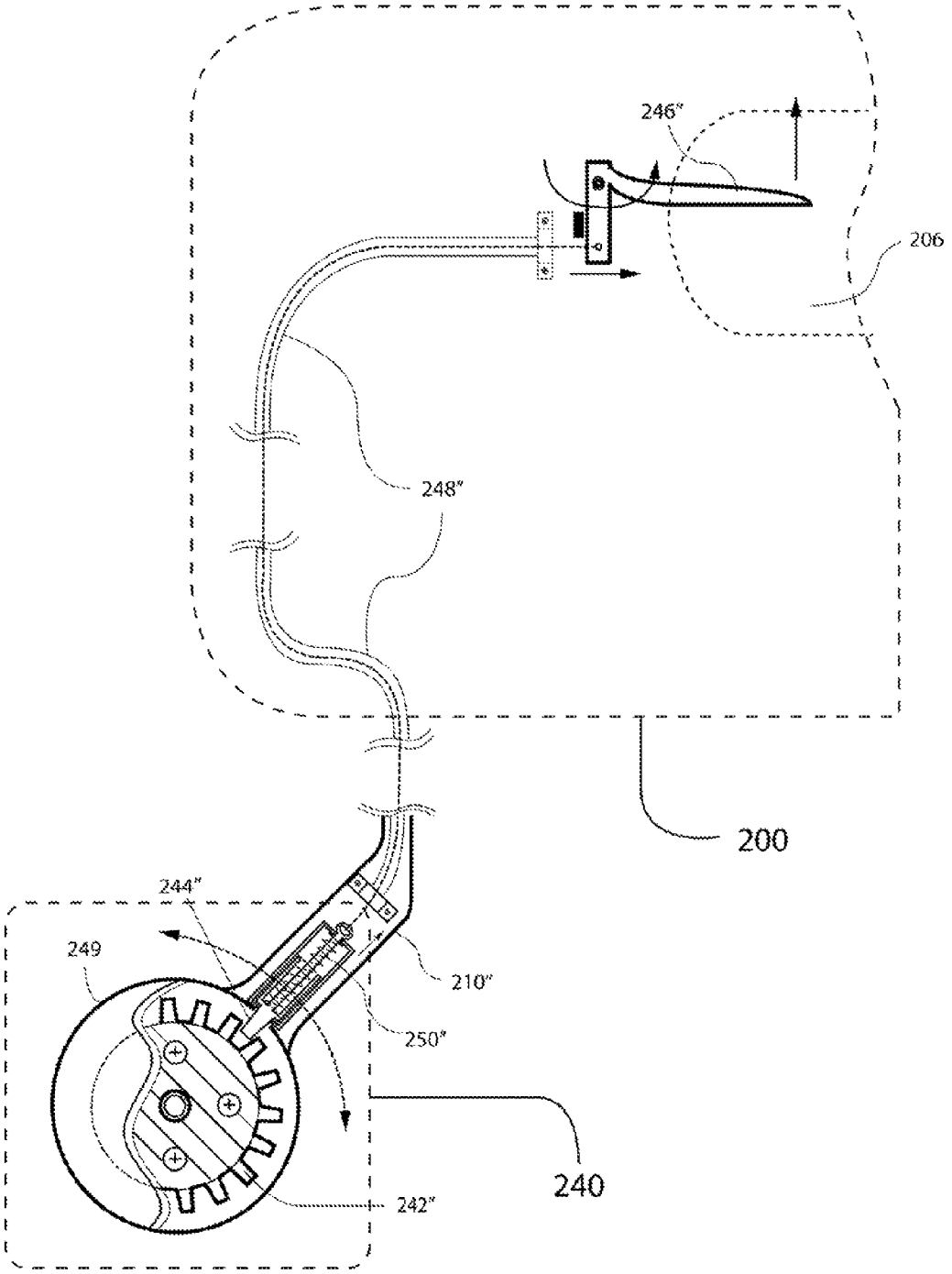
FIG. 6*c* illustrates a detail view for explaining a multiple positioning fix unit of a support board being used for a back pack for a mobile device user according to a third embodiment of the present invention.

FIG. 6*a* illustrates a side view illustrating a structure of a support board being used for a back pack for a mobile device user according to a third embodiment of the present invention, FIG. 6*b* illustrates a front view illustrating a structure of a support board being used for a back pack for a mobile device user according to a third embodiment of the present invention, and FIG. 6*c* illustrates a detail view for explaining a multiple positioning fix unit of a support board being used for a back pack for a mobile device user according to a third embodiment of the present invention. In the back pack 10 for the mobile device user according to the third embodiment illustrated in FIGS. 6*a* to 6*c*, it should be noted that the hinge 220 and the multiple positioning fix unit 240 are formed as an integrally combined type on the lateral side(s) 130.

Referring to FIGS. 6*a* to 6*c* together with FIGS. 5*a* to 5*c*, first, in order to return support board 200 back directly to the position A (closed position) after opening the support board 200 from the position A (closed position) to the desired position C (use position) and using it at the desired position C (use position) in the second embodiment illustrated in FIGS. 5*a* to 5*c*, it is required to move the support board 200 firstly to the position A (closed position) in order for the release cam 246 to be operated, subsequently to move the support board 200 to the position B (completely open position), and then again to rotate the support board 200 pivotally in a counter-clockwise direction so as to fix the support board 200 to a desired use position (e.g., the position C). That is, it is required to operate the release cam 246 firstly to cause the engagement of the geared wheel 242 and the stopper 244 to be released.

On the contrary, in the third embodiment illustrated in FIGS. 6*a* and 6*b*, the multiple positioning fix unit 240 comprises a geared wheel 242", a stopper 244", a disengaging lever or release lever 246" (hereinafter "release lever"), and a pulling wire 248". An opening 206 is provided on a top position of the support board 200 so as for the user to open the support board 200 easily by griping the support board 200. Further, the release lever 246" is arranged inside the opening 206 and the pulling wire 248" attached to one end of the release lever 246" is connected to the stopper 244" to exert tensile force thereto. The stopper 244" always maintains the state of being engaged with the geared wheel 242" by biased force of a coil spring 250". When pressing the release lever 246" inside the opening 206 toward an upper direction in FIG. 6*b* by using a finger, the wire (shown as a dotted line in FIG. 6*c*) is pulled, and subsequently the stopper 244" being connected to one end of the wire (shown as the dotted line) is also pulled so that the engagement between the geared wheel 242" and the stopper 244" is released. As a result, the support board 200 can be pivotally rotated freely either in a clockwise direction or in a counter-clockwise direction. After setting the support board 200 at a desired position and then releasing the release lever 246", the geared wheel 242" and the stopper 244" are engaged with each other and thus maintain again an engagement state so that the support board 200 is fixed securely at the desired position. It is desirable that the release lever 246" and the pulling wire 248" are made of a thin material in order for them to be embedded inside the support board 200. In FIG. 6*c*, the geared wheel 242" is arranged on the lateral side(s) 130 of the body 100 (see FIG. 2*a*), and the support board 200 is coupled to a casing 249, which is rotated pivotally together with the geared wheel 242" on a coaxial axis, and the extension arm 210". It is desirable that the stopper 244" is embedded in an inner cavity of the extension arm 210".

Although the number of parts for the elements used for the back pack 10 in the third embodiment of the present invention may slightly increase when compared with those in the second embodiment, it may become a more desirable design for the user because the support board 200 can be opened and closed more easily.

In the meanwhile, although the extension arm 210" is illustrated as an example to be a linear type in the third embodiment of the present invention as described in detail above, any skilled person in the art can fully understand that the extension arm 210" can be embodied as a curved type or an angled type, depending on necessity and design.

Fourth Embodiment

Figure 6D:
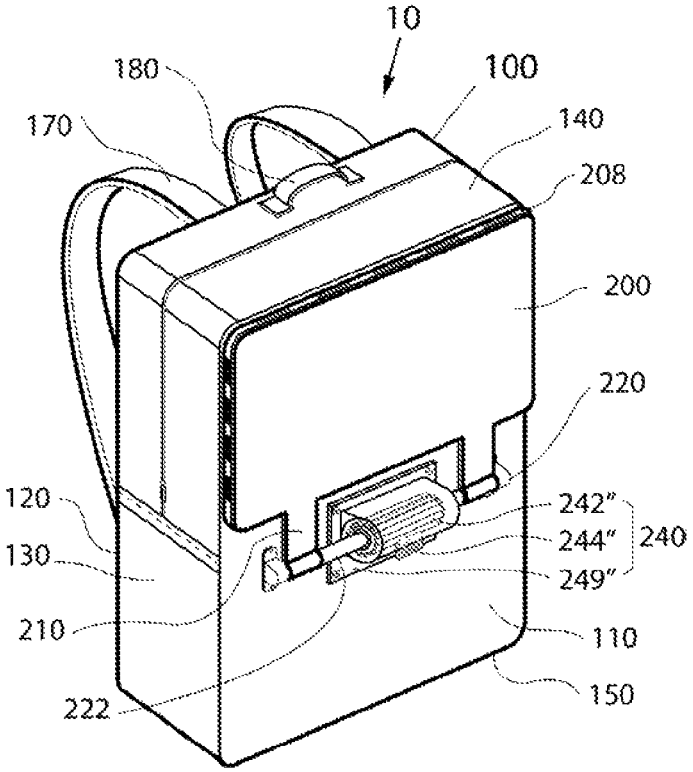
FIG. 6*d* illustrates a perspective view of another embodiment where the embodiment illustrated in FIG. 3 and the embodiment illustrated in FIGS. 6*a* and 6*b* are combined.
Figure 6E:
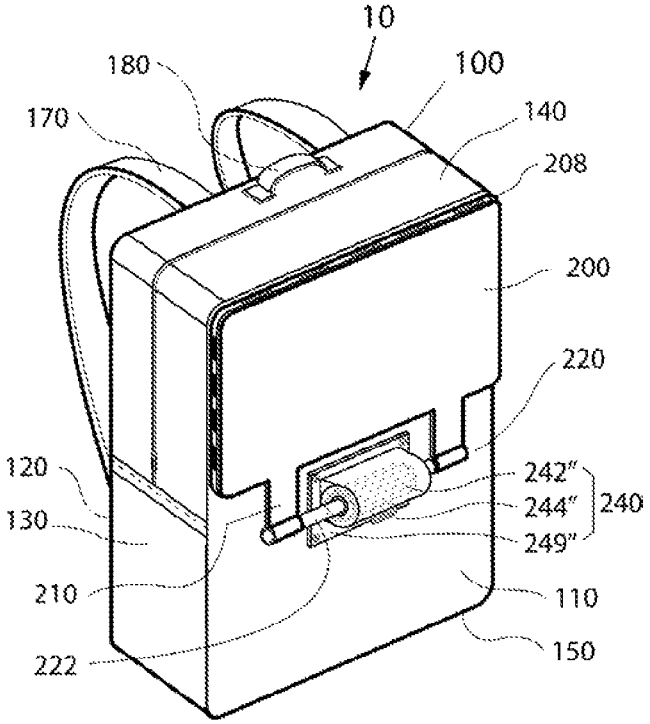
FIG. 6*e* illustrates a perspective view of yet another embodiment where the embodiment illustrated in FIG. 3 and the embodiment illustrated in FIGS. 6*a* and 6*b* are combined.

FIG. 6*d* illustrates a perspective view of a back pack structure for a mobile device user according to a fourth embodiment of the present invention, and FIG. 6*e* illustrates a perspective view of another back pack structure for a mobile device user according to a fourth embodiment of the present invention.

In the back pack 10 according to the fourth embodiment of the present invention illustrated in FIGS. 6*d* and 6*e*, the hinge 220 and the multiple positioning fix unit 240 are formed as an integrally combined type on the lateral side(s) 130.

Referring to FIGS. 6*d* and 6*e* together with FIGS. 3 to 6*a*, the embodiment illustrated in FIG. 6*d* is embodied by partially combining the first embodiment illustrated in FIG. 3, the second embodiment illustrated in FIGS. 5*a* to 5*c*, and the third embodiment illustrated in FIG. 6*a*. That is, there is a difference in that the multiple positioning fix unit 240 illustrated in FIG. 3 is embodied as a linear type ratchet assembly, while the multiple positioning fix unit 240 illustrated in FIG. 6*d* is embodied by a wheel type ratchet assembly. In the wheel type ratchet assembly to be used as the multiple positioning fix unit 240 in FIG. 6*d*, a large width geared wheel 242" (shown in a thin solid line) and the stopper 244" are built together into the casing 249", and the casing 249" is provided on the front side 110 of the body 100. The geared wheel 242" is pivotally coupled to the hinge 220 by way of a rotational axis 220. The rotational motion of the geared wheel 242" can be controlled by manipulating the stopper 244" manually, while the method of releasing the engagement in the third embodiment may be employed, if necessary. Since the rotational axis 220 is connected to the extension arm 210 and is rotated together with the support board 200, the closed and open positions of the support board 200 can be fixed in the same way as those of the first to third embodiments described in detail above.

In the meanwhile, referring to FIG. 6*e*, it can be recognized that the hinge 220 and the multiple positioning fix unit 240 are formed as an integrally combined type by embedding the hinge 220 illustrated in FIG. 6*d* into the multiple positioning fix unit 240. The embodiment of FIG. 6*e* is similar to the second and third embodiments as described in detail and thus a detailed description thereof will be omitted. It should be noted that the back pack 10 of the present invention can be embodied in a more simplified and convenient structure by the structure of the fourth embodiment.

The back pack 10 of the present invention as described above can be embodied generally by a soft shell back pack made of a soft outer cover such as a leather material. Also the back pack 10 can be embodied by a hard shell back pack made of a hard outer cover with high solidness and stiffness such as plastic resin such as PVC, PE, and PP, high stiffness engineering resin such as polycarbonate (PC) resin or FRP resin, or a metal material, etc.

As described in detail above, in case that the body 100 of the back pack 10 is embodied by a soft shell back pack, the body 100 of the back pack 10 is difficult to maintain a specific shape to hold the multiple positioning fix unit 240 firmly so that the support board 200 and the multiple positioning fix unit 240 may not provide sufficient support force. Thus, it is desirable that a support frame, as illustrated in FIGS. 7 and 8 which will be described later, needs to be provided inside or outside the front side 110 of the body 100 in order for the support board 200 and the multiple positioning fix unit 240 to maintain sufficient support force.

Figure 7:
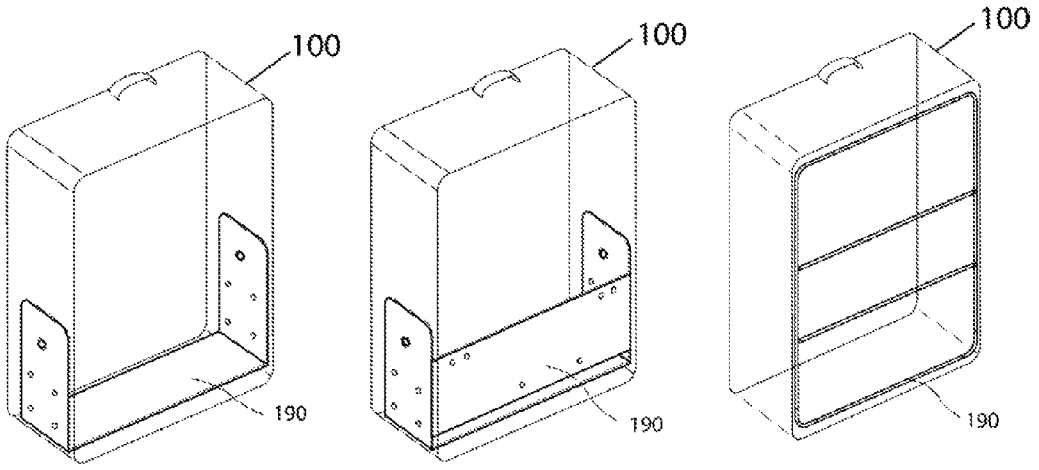
FIG. 7 illustrates a perspective view of various embodiments of a support frame which is additionally provided inside a back pack for a mobile device user according to the present invention.

FIG. 7 illustrates a perspective view of various embodiments of a support frame which is additionally provided inside of a back pack for a mobile device user according to the present invention.

Referring to FIG. 7, the back pack 10 for a mobile device user according to the present invention further comprises a support frame 190 capable of securing the hinge 220 on either side, such as inside or outside, of the body 100, in order to secure the support board 200, the hinge 220, and the multiple positioning fix unit 240 in the first to the third embodiments as described above to the body 100 of the back pack 10. Even if the body 100 is embodied by a soft shell back pack, sufficient support force can be provided to the hinge 220 or the multiple positioning fix unit 240 by installing the hinge 220 or the multiple positioning fix unit 240 on the support frame 190. The support frame 190 is made of plastic resin such as PVC, PE, and PP, high stiffness engineering plastic resin such as polycarbonate (PC) resin or FRP resin, bakelite, wood, plywood, or various metal materials, etc. The support frame 190 can have various shapes such as a plate shape, a wire shape, a rod shape, or any combination thereof, depending on the specification and design of the back pack.

Figure 8A:
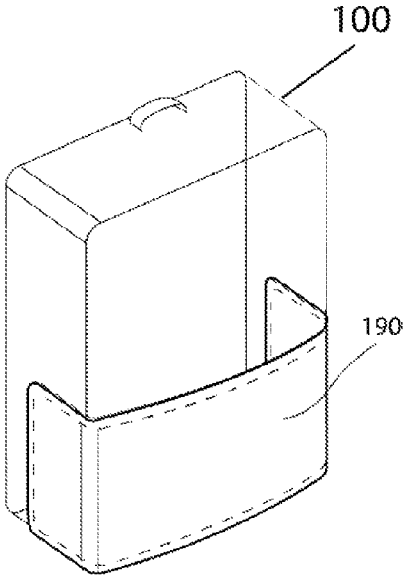
FIG. 8*a* illustrates a perspective view illustrating an embodiment where a hard shell support frame is additionally provided to a portion of a front side of a back pack for a mobile device user according to the present invention.

FIG. 8*a* illustrates a perspective view illustrating an embodiment where a hard shell support frame is additionally provided to a portion of a front side of a back pack for a mobile device user according to the present invention.

Referring to FIG. 8*a*, the back pack 10 for a mobile device user according to the present invention further comprises a hard shell support frame 190 to a portion of the front side 110. This hard shell support frame 190 can be provided inside or outside the back pack 10. Therefore, the hard shell support frame 190 can further provide a function for protecting the items to be received inside the back pack 10 from an external impact.

Figure 8B:
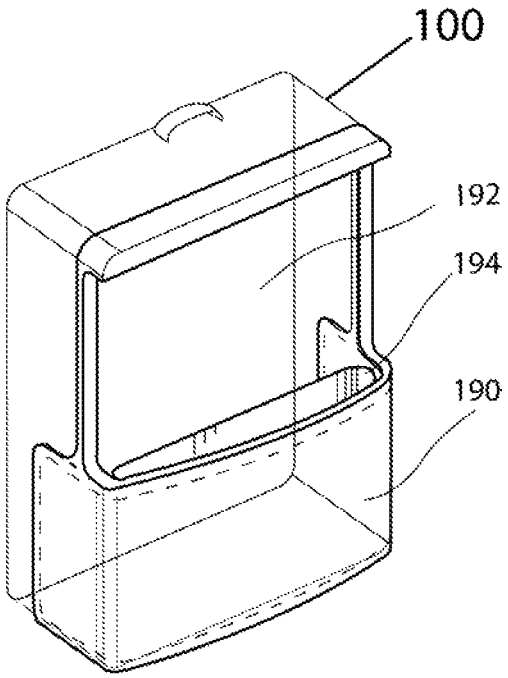
FIG. 8*b* illustrates a perspective view illustrating another embodiment where a hard shell support frame is additionally provided to a front side of a back pack for a mobile device user according to the present invention.

FIG. 8*b* illustrates a perspective view illustrating another embodiment where a hard shell support frame is additionally provided to a front side of a back pack for a mobile device user according to the present invention.

Referring to FIG. 8*b*, the back pack 10 for a mobile device user according to the present invention further comprises a storage pocket 194 for storing the mobile device inside a front opening 192 which is formed on a portion of the front side 110. Since the front opening 192 is covered with the support board 200 of the present invention as described above, it is not only convenient for the user to use the mobile device being stored in the storage pocket 194 at any desired time when the user needs to use it while the support board 200 is in an open state, but also advantageous that the high-priced mobile device being stored in the storage pocket 194 can be prevented from being damaged due to an external impact.

Figure 9:
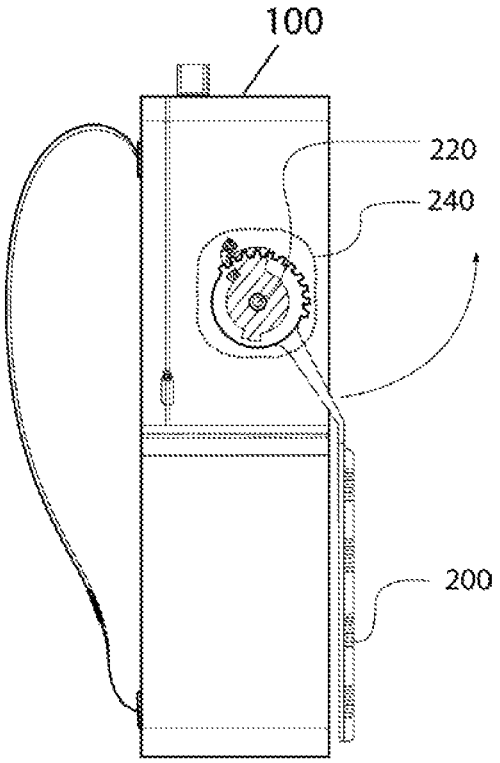
FIG. 9 illustrates a perspective view illustrating another embodiment where a support board is installed downwardly on a back pack for a mobile device user according to the present invention.

FIG. 9 illustrates a perspective view illustrating another embodiment where a support board is installed downwardly on a back pack for a mobile device user according to the present invention.

Referring to FIG. 9, the back pack 10 according the present invention is the same as that according to the embodiments illustrated in FIGS. 5*a* to 6*c*, except that the support board 200 is stored in a downward direction and is rotated pivotally and opened in a count-clockwise direction when using it. It should be noted that, when comparing with the embodiments illustrated in FIGS. 5*a* to 6*c*, the structure and operations of the hinge 220 and the multiple positioning fix unit 240 in the back pack 10 according the embodiment illustrated in FIG. 9 are substantially the same as those of the first to the third embodiments as described above, except the closed position and rotational direction of the support board 200.

Figure 10:
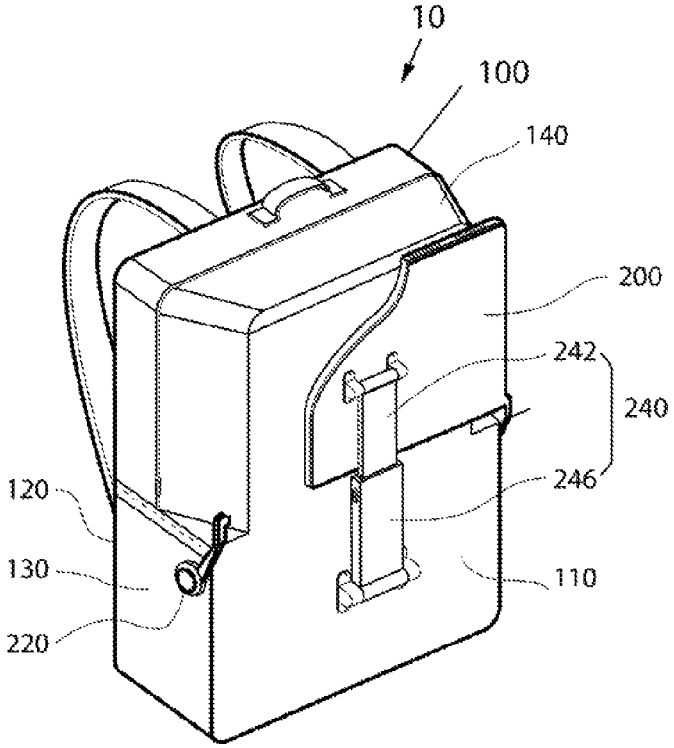
FIG. 10 illustrates a perspective view illustrating an embodiment where a partial transverse plane of a back pack for a mobile device user according to the present invention is formed as a trapezoidal shape.
Figure 11:
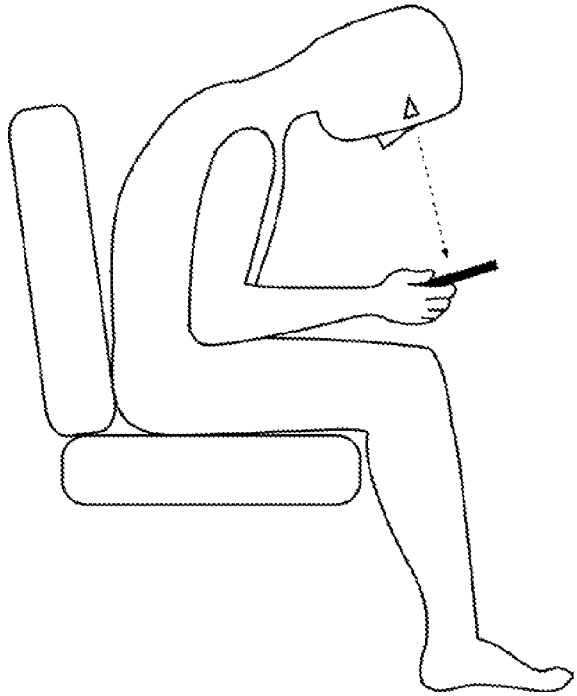
FIG. 11 illustrates a side view for explaining a typical posture of the user while using a mobile device in a sitting position.

FIG. 10 illustrates a perspective view illustrating an embodiment where a partial transverse plane of a back pack for a mobile device user according to the present invention is formed as a trapezoidal shape.

Referring to FIG. 10, an embodiment is illustrated where a portion of appearance of the front side 110 and the lateral sides 130 at the body 100 of the back pack 10 is changed. More specifically, when viewed from the top at the time of placing the user's arms on the support board 200, the user's arms form a triangular configuration while the user's arms are closing together. Therefore, it can be fully understandable that it is convenient for the front side 110 of the body 100 to have a shape in width narrower than the back side 120. That is, in the embodiment in FIG. 10, it is desirable that an upper cross-section of the body 100 is embodied to have a trapezoidal shape or a semi-circular shape (not shown) in order for the front side 110 to have a narrower width than the back side 120. Especially, if the user is a female who usually has a narrower shoulder width than a male, additional advantage may be accomplished in that such a female user can avoid some interference between her arms and the lateral sides 130 of the body 100 by using the back pack structure illustrated in FIG. 10.

FIG. 12 illustrates a side view of a desirable posture of the user while using a mobile device on a back pack according to the present invention in a sitting position on a chair.

Referring to FIG. 12 together with FIGS. 1 to 10, it is illustrated that a user for a mobile device uses the back pack 10 of the present invention while sitting on a chair. In this case, the user can open the support board 200 by a desired angle, while the upper portion of the back pack 10 is leaned on a chest of the user's body and the bottom portion of the back pack 10 is placed on a thigh thereof. Then, the user can place the mobile device on the support board 200 opened appropriately and use it conveniently by using his or her hands or arms. Therefore, the user can keep a proper posture by using the back pack 10 having the support board 200 and also use the mobile device very stably and conveniently.

FIG. 13 illustrates a side view of a desirable posture of the user while using a mobile device on a back pack according to the present invention in a standing position.

Referring to FIG. 13 together with FIGS. 1 to 10, the user can place and use the mobile device on the support board 200 after opening the support board 200, even in a standing position with wearing the back pack 10 of the present invention in a front direction of the user's body.

FIG. 14 illustrates a side view of a desirable posture of the user while using a mobile device on a back pack according to the present invention on a desk.

Referring to FIG. 14, the support board 200 of the back pack 10 of the present invention can be used as a book stand, because books can be placed on the support board 200. Even if the support board 200 is used as a book stand, the back pack 10 of the present invention can advantageously provide convenience as well as help to the user's health, since the user can also keep a proper posture.

INDUSTRIAL APPLICABILITY

As various modifications could be made in the constructions and method herein described and illustrated without departing from the scope of the present invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A back pack for a mobile device user comprising:

a body;

a support board adjacently facing a front side of the body in parallel;

a hinge, being provided on the front side or on one or both of lateral sides of the body, for pivotally coupling the support board and the body; and a multiple positioning fix unit to fix the support board at an open position, wherein the support board is provided as a separate element from the front side of the body, and is configured to support a mobile device thereon, and wherein the support board is pivotally coupled to the body by the hinge and the multiple positioning fix unit so as to adjust an open angle of the support board with the front side of the body of the back pack being closed, and wherein the multiple positioning fix unit is formed by either a linear type ratchet assembly or a wheel type ratchet assembly.

2. The back pack for a mobile device user of claim 1, wherein the support board further comprises a resilient layer member on at least a portion of the support board.

3. The back pack for a mobile device user of claim 1, wherein the support board further comprises a ledge member for preventing a mobile device from sliding down while the support board is in the open position.

4. The back pack for a mobile device user of claim 1, wherein the hinge is provided on the one or both of lateral sides, and the hinge and the multiple positioning fix unit are formed as an integrally combined type.

5. The back pack for a mobile device user of claim 1, wherein the hinge is provided on the front side, and the hinge and the multiple positioning fix unit are formed as an integrally combined type.

6. The back pack for a mobile device user of claim 1, wherein the hinge is provided on the front side, and the hinge and the multiple positioning fix unit are formed as a separable type.

7. The back pack for a mobile device user of claim 1, wherein the back pack further comprises a support frame for supporting at least one of the support board, the hinge, and the multiple positioning fix unit to at least a portion of the body.

8. The back pack for a mobile device user of claim 1, wherein the back pack further comprises a hard shell to at least one side of the body.

9. A back pack for a mobile device user comprising:

a body;

a support board adjacently facing a front side of the body in parallel;

a hinge, being provided on the front side or on one or both of lateral sides of the body, for pivotally coupling the support board and the body; and a multiple positioning fix unit to fix the support board at an open position, wherein the support board is provided as a separate element from the front side of the body, and is configured to support a mobile device thereon, and wherein the support board is pivotally coupled to the body by the hinge and the multiple positioning fix unit so as to adjust an open angle of the support board with the front side of the body of the back pack being closed, and wherein the back pack further comprises an extension arm for connecting the support board to the hinge, and wherein the extension arm is capable of adjusting a length thereof.

10. A back pack for a mobile device user comprising:

a body;

a support board adjacently facing a front side of the body in parallel;

a hinge, being provided on the front side or on one or both of lateral sides of the body, for pivotally coupling the support board and the body; and a multiple positioning fix unit to fix the support board at an open position, wherein the support board is provided as a separate element from the front side of the body, and is configured to support a mobile device thereon, and wherein the support board is pivotally coupled to the body by the hinge and the multiple positioning fix unit so as to adjust an open angle of the support board with the front side of the body of the back pack being closed, and wherein the back pack further comprises a fall-prevention member, being provided between a bottom of the support board and the front side, for preventing a mobile device from falling downwardly.

11. The back pack for a mobile device user of claim 1, wherein an upper cross section of the body has a trapezoidal shape in order for the front side to have a narrower width than the back side.

* * * * *